United States Patent [19]

Tomuro

[11] 4,271,608

[45] Jun. 9, 1981

[54] SPIKE SHOE

[76] Inventor: Yasushi Tomuro, No. 11-3 Tamagawa Denenchofu 2-chome, Setagaya-ku, Tokyo, Japan

[21] Appl. No.: 56,542

[22] Filed: Jul. 11, 1979

[30] Foreign Application Priority Data

Aug. 16, 1978 [JP] Japan ..... 53-111464[U]

[51] Int. Cl.[3] ..... A43C 15/00; A43B 5/00

[52] U.S. Cl. ..... 36/61; 36/59 R; 36/127; 36/134

[58] Field of Search ..... 36/61, 59 R, 7.6, 7.7, 36/134, 127

[56] References Cited

U.S. PATENT DOCUMENTS

| | | | |
|---|---|---|---|
| 303,287 | 8/1884 | Hunn | 36/59 R |
| 3,747,238 | 7/1973 | Jankauskas | 36/61 |
| 3,793,751 | 2/1974 | Gordos | 36/61 |
| 4,146,979 | 4/1979 | Fabbrie | 36/59 R |

FOREIGN PATENT DOCUMENTS

| | | | |
|---|---|---|---|
| 2262528 | 6/1974 | Fed. Rep. of Germany | 36/61 |
| 1438333 | 6/1976 | United Kingdom | 36/61 |

*Primary Examiner*—James Kee Chi

*Attorney, Agent, or Firm*—Thomas R. Morrison

[57] ABSTRACT

This invention relates to a spike shoe including a sole, a plurality of spike pins mounted thereupon and a resilient elastic material fixed with the sole, the resilient elastic material having such a thickness that each spike pin can be concealed therein, and including a plurality of holes in order to permit the spike pins to protrude from the resilient elastic material when the weight of human body is applied to the spike shoe, whereby the spike pins are forced into the ground. When the weight is removed from the sole, the spike pins are retracted into the resilient material leaving any mud which may have been stuck to the pins on the smooth bottom surface of the sole from which the mud may be easily removed.

4 Claims, 8 Drawing Figures

SPIKE SHOE

BACKGROUND OF THE INVENTION

This invention relates to a spike shoe in which a shoe sole is provided with a elastic material.

Conventional spike shoes for golf and other sports comprise various shapes of spike pins. As the number of spike pins is increased and each spike pin's shape becomes more complicated, muds, trash or the like are apt to stick to the sole or to portions between adjacent spike pins. Unless a user removes such mud from time to time, every time he or she steps the ground, new mud sticks to the sole or to portions between adjacent spike pins and accumulates gradually just like snow accelerates on shoe soles. The thus accumulated mud may harden, and finally become difficult to remove from the sole or the spike pins. If the user attempts to use a pair of spike shoes having mud stuck to the spike pins or soles, the function of the spike shoes is lost. In order to overcome the above disadvantage of conventional spike shoes, the present invention has been attained.

BRIEF SUMMARY OF THE INVENTION

Therefore, it is an object of this invention to provide a spike shoe including a shoe bottom base, a plurality of spike pins mounted thereupon and a resilient elastic material fixed with the bottom base, the resilient elastic material having such a thickness that each spike pin can be concealed therein, and forming a plurality of holes in order to cause to freely expose the spike pins from the resilient elastic material. When the weight of a human body is applied to the spike shoe, the elastic material is compressed, whereby the spike pins are exposed therefrom and forced into the ground.

It is another object of this invention to provide a spike shoe in which the bottom of the resilient elastic material is provided with a strong bottom sheet. The durability of the repellent elastic material is thus increased and any mud or the like is prevented from penetrating into the elastic material.

Other objects and aspects of this invention will become apparent from the following description of embodiments with reference to the accompanying drawings.

DETAILED DESCRIPTION OF THE INVENTION

Figure 1:
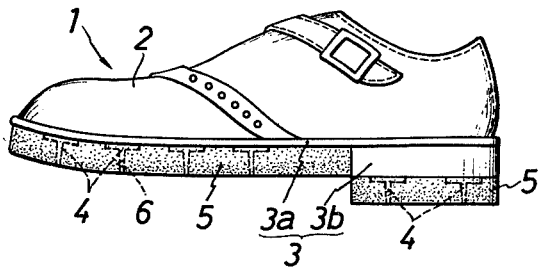
FIG. 1 is a side view of an embodiment of a spike shoe according to this invention.
Figure 2:
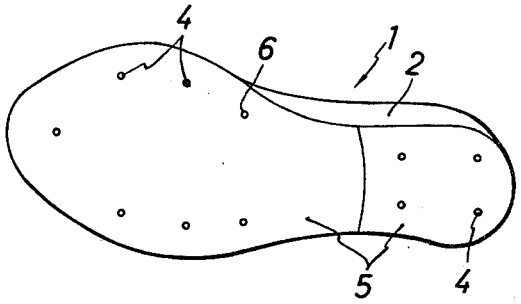
FIG. 2 is a bottom view of FIG. 1.

Preferred embodiments of this invention will now be described in connection with the accompanying drawings.

Numeral 1 is a spike shoe for golf and other various sports. The spike shoe 1 comprises a shoe upper 2 preferably of leather, a bottom base (or sole) 3 consisting a front base 3*a* and a heel 3*b*, and a plurality of spike pins 4 mounted upon the bottom base 3 in holes 6.

The plurality of spike pins 4 each having a cone shape are mounted at a preferred spacing upon the bottom base 3 by conventional means.

A resilient elastic material 5 is bonded to the bottom base 3. Resilient elastic material 5 has a thickness at least equal to the height of the spike pin 4 so that the spike pin 4 can be concealed within the elastic material 5.

When the weight of a human body is applied to the spike shoe 1, the elastic material 5 is compressed, whereby the spike pins being exposed therefrom and forced into the ground. Thus, the elastic material 5 has sufficient resilience to expose the spike pins from the surface of the compressed elastic material 5, and is made of closed-cell foamed (or sponge-like) plastic material of e.g. a preferred synthetic resin which is water proof and has good weatherability, so that water, rain, trash or the like cannot penetrate into the elastic material 5.

Figure 3:
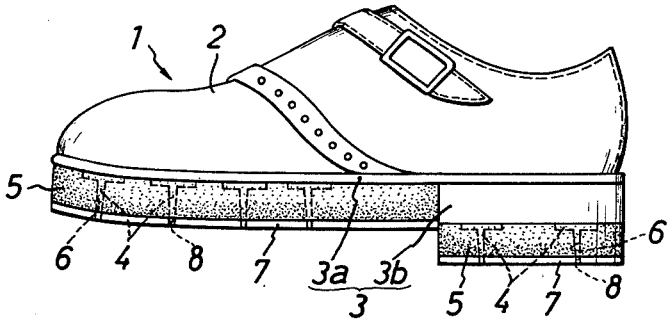
FIGS. 3, 6 and 7 are side views of various embodiments of this invention.
Figure 4:
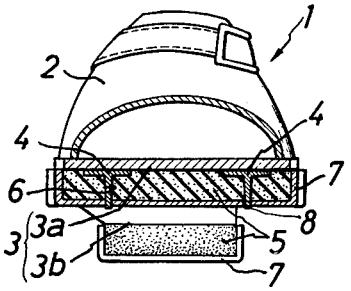
FIG. 4 is a front view of an embodiment of the invention.

FIG. 3 is another example of this invention in which the resilient elastic material 5 is provided with a strong elastic bottom sheet 7 made of plastic leather, rubber or the like having high wear resistance and long durability. In the strong bottom sheet 7 a plurality of holes 8 are formed through which the plurality of spike pins 4 may freely pass.

Figure 5A:
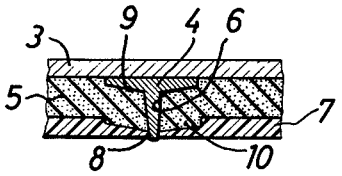
FIGS. 5*a* and 5*b* are section views of main parts according to this invention.
Figure 5B:
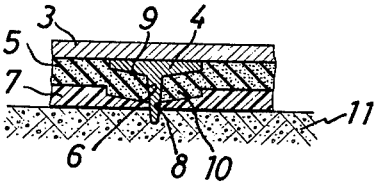

The holes 8 are formed in the centers of concave portion 10 of the bottom sheet 7 as shown in FIG. 5*a*. When the weight of a human body is applied to the spike shoe 1, deformation of the bottom sheet 7 is avoided due to the concave portion 10 providing clearance for mounting portions 9 of spike pins 4. Further, the spike pin 4 can be exposed easily due to the concave portion 10. FIG. 5*b* shows the condition in which the spike pin 4 is forced into the ground 11.

Figure 6:
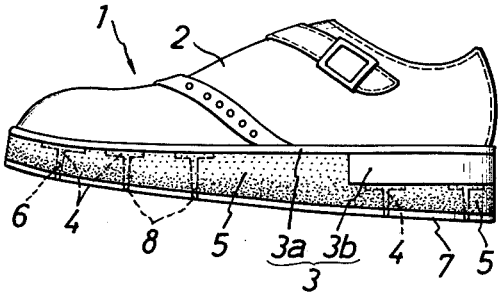
Figure 7:
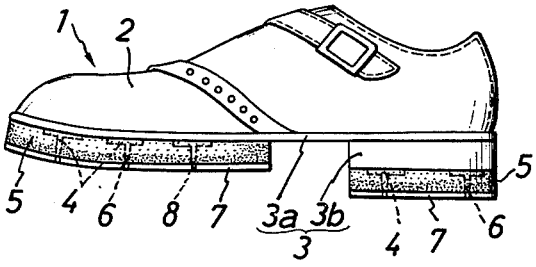

Further, as shown in FIG. 6 the resilient elastic material 5 may be formed to provide a single bottom surface covered by the bottom sheet 7 over the sole. Alternatively, as shown in FIG. 7, the elastic material 5 may be divided into two parts, whereby a portion which does not contact the ground is not covered by the elastic material 5.

In the above embodiments a plurality of cone-shaped spike pins are mounted on the sole 3 for special application to golf shoes. However, the shape of the spike pins is not limited to the cone shape. By considering the features of various sports, various shapes of the spike pins are mountable on the sole. For example, in order to apply the spike shoes for use in baseball, a plurality of spike pins each having a rectangular shaped section may be used.

As the spike pins 4 wear out, it is natural that the strong bottom sheet 7 and the elastic material 5 may also be worn out. Then, it is easy to replace them with new bottom sheet, new spike pins and new elastic material.

As described above, when a person puts on a pair of spike shoes according to this invention, the resilient elastic material 5 is pressed due to his or her weight, whereby the spike pins are exposed therefrom and forced into the ground. Mud or trash stuck to the spike pins is removed therefrom due to elasticity of the material 5 as soon as the person lifts the spike shoe from the ground.

In case mud is stuck to the underside of the elastic material 5, it can be remove by scraping with a flat stone, a brush or the like.

Since mud stuck to the spike pins can always be removed due to an resilient action of the elastic material, trouble with mud sticking is eliminated. Accordingly, during sport playing, it is necessary to stop play to remove mud stuck to the spike pins. Thus, the inconveniences and disadvantages of conventional spike shoes are avoided.

Still further, when the underside of the elastic material is provided with a strong bottom sheet which contacts the ground, the durability of the spike shoe is further increased and mud or the like is prevented from penetrating into the resilient elastic material.

What is claimed is:

1. A spike shoe comprising:

a shoe upper;

a bottom base on the bottom of said upper;

a layer of resilient elastic material affixed to said bottom base;

a bottom sheet covering the bottom of said layer, said bottom sheet having high wear resistance;

a plurality of holes through said layer and said bottom sheet;

a plurality of spike pins in said plurality of holes attached to said bottom base and extending toward said layer;

each of said spike pins having a spike portion and a mounting portion, each said mounting portion being wider than its respective spike portion and being located in abutment with said bottom base and extending part way toward said bottom sheet;

said layer having a thickness sufficient to completely contain said spike pins when said layer is in an uncompressed condition;

each of said plurality of holes being closely fitted to a respective one of said spike pins;

said layer having a resilience sufficient to permit compression thereof under the weight of a human body which is effective to extend a substantial portion of said spike portions beyond said bottom sheet;

concave portions in the upper surface of said bottom sheet, one concave portion surrounding each of said holes and each having a contour which is effective to permit its respective mounting portion to approach said bottom sheet during compression of said layer without deforming said bottom sheet;

said layer being effective to increase its thickness sufficiently when said weight is removed to cover said spike pins, such increase in thickness being effective to remove mud and other matter from said spike portions as a result of the close fit between said holes and said spike pins and leave a bottom surface of said bottom sheet without protrusion of said spike portions therepast whereby said mud and other matter may be easily scraped therefrom.

2. A spike shoe according to claim 1 wherein said layer and said bottom sheet include a first layer and a first bottom sheet on a sole portion of said spike shoe and a second layer and a second bottom sheet on a heel portion of said spike shoe.

3. A spike shoe according to claim 2 wherein said first and second layers are spaced apart.

4. A spike shoe according to claim 1 wherein said layer and said bottom sheet cover a sole portion and a heel portion of said spike shoe.

* * * * *